US009855571B2

(12) United States Patent
Camilleri et al.

(10) Patent No.: US 9,855,571 B2
(45) Date of Patent: Jan. 2, 2018

(54) DISPOSABLE ASSEMBLY FOR PREPARING AND WORKING PAINT OR FOR SPRAYING A PRODUCT RESULTING FROM MIXING AT LEAST TWO COMPONENTS, TO BE USED AS A BUCKET ON A SPRAYING TOOL

(71) Applicants: Michel Camilleri, Souffelweyersheim (FR); Joseph Guarino, Mazan (FR)

(72) Inventors: Michel Camilleri, Souffelweyersheim (FR); Joseph Guarino, Mazan (FR)

( * ) Notice: Subject to any disclaimer, the term of this patent is extended or adjusted under 35 U.S.C. 154(b) by 119 days.

(21) Appl. No.: 14/760,616

(22) PCT Filed: Jan. 14, 2013

(86) PCT No.: PCT/FR2013/000016
§ 371 (c)(1),
(2) Date: Jul. 13, 2015

(87) PCT Pub. No.: WO2014/108606
PCT Pub. Date: Jul. 17, 2014

(65) Prior Publication Data
US 2015/0360248 A1 Dec. 17, 2015

(51) Int. Cl.
*B05B 7/24* (2006.01)
*B65D 25/54* (2006.01)
(Continued)

(52) U.S. Cl.
CPC ..... *B05B 7/2478* (2013.01); *B01F 13/0023* (2013.01); *B01F 13/0052* (2013.01);
(Continued)

(58) Field of Classification Search
CPC . B05B 7/2478; B05B 7/2408; B01F 13/0023; B01F 13/0052; B01F 15/00512;
(Continued)

(56) References Cited

U.S. PATENT DOCUMENTS 1,706,335 A * 3/1929 Toch ..... B44D 3/122 206/221
3,696,919 A * 10/1972 Miles ..... B65D 81/3222 206/221

(Continued)

FOREIGN PATENT DOCUMENTS

| | | | |
|---|---|---|---|
| DE | 102008026270 | A1 | 12/2009 |
| FR | 2708870 | A1 | 2/1995 |
| WO | WO-2005/070557 | A1 | 8/2005 |

OTHER PUBLICATIONS

International Search Report issued in Application No. PCT/FR2013/000016 dated Aug. 2, 2013.

*Primary Examiner* — Chun Cheung
(74) *Attorney, Agent, or Firm* — Marshall, Gerstein & Borun LLP

(57) ABSTRACT

The disposable assembly has a closed body, for containing a first component and having a lateral surface, a bottom and an upper opening. The bottom has a mounting projection extending within the body for its sealed interlocking engagement in the complementary conformation of the lower end of a hollow inner tubular member intended to contain a second component while its other end is closed by a sealing means. A shutter is tightly mounted on the opening of the body using screws, or by clipping or interlocking. The shutter and the sealing means or the shutter and the hollow tubular element can be a single piece. The presently described embodiments are suitable for producers of paint, varnishes, primers and other products to be sprayed or projected using a gun and other manufacturers of spray or paint guns.

28 Claims, 7 Drawing Sheets

(51) Int. Cl.

| | |
|---|---|
| ***B65D 47/32*** | (2006.01) |
| ***B01F 13/00*** | (2006.01) |
| ***B01F 15/00*** | (2006.01) |
| ***B01F 15/02*** | (2006.01) |
| ***B65D 81/32*** | (2006.01) |
| *B05B 15/00* | (2006.01) |

(52) U.S. Cl.
CPC .... *B01F 15/00512* (2013.01); *B01F 15/0215* (2013.01); *B01F 15/0224* (2013.01); *B05B 7/247* (2013.01); *B05B 7/2408* (2013.01); *B05B 7/2472* (2013.01); *B65D 25/54* (2013.01); *B65D 47/32* (2013.01); *B65D 81/3222* (2013.01); *B01F 2215/005* (2013.01); *B05B 15/008* (2013.01)

(58) Field of Classification Search
CPC ..... B01F 15/0215; B01F 15/0224; G06F 19/3462; B65D 25/54; B65D 47/32
USPC ..... 206/219–222
See application file for complete search history.

(56) References Cited

U.S. PATENT DOCUMENTS

| | | | | |
|---|---|---|---|---|
| 3,856,138 | A * | 12/1974 | Maekawa | B65D 81/3222 206/221 |
| 4,410,085 | A | 10/1983 | Beneziat et al. | |
| 8,083,056 | B1 * | 12/2011 | Wu | B65D 25/08 206/221 |
| 8,104,611 | B2 * | 1/2012 | Helou, Jr. | B65D 81/3222 206/219 |
| 8,875,874 | B2 * | 11/2014 | Helou, Jr. | B65D 81/3222 206/219 |
| 2009/0188987 | A1 * | 7/2009 | Connelly | B05B 7/2408 239/8 |
| 2009/0211927 | A1 * | 8/2009 | Wu | B65D 81/3222 206/219 |
| 2009/0294397 | A1 | 12/2009 | Wu | |
| 2011/0192734 | A1 * | 8/2011 | Helou, Jr. | B65D 81/3222 206/219 |
| 2015/0016208 | A1 * | 1/2015 | Larson | B01F 15/0212 366/130 |

* cited by examiner 1
2
3
4
5
6
7
8
10
11
13
16
17
18
20
23, 24
25
26
27, 28
31
33

DISPOSABLE ASSEMBLY FOR PREPARING AND WORKING PAINT OR FOR SPRAYING A PRODUCT RESULTING FROM MIXING AT LEAST TWO COMPONENTS, TO BE USED AS A BUCKET ON A SPRAYING TOOL

CROSS-REFERENCE TO RELATED APPLICATIONS

This application is a national stage application, and claims the benefit of priority, of International Patent Application No. PCT/FR2013/000016, filed Jan. 14, 2013, and entitled "DISPOSABLE ASSEMBLY FOR PREPARING AND WORKING PAINT OR FOR SPRAYING A PRODUCT RESULTING FROM MIXING AT LEAST TWO COMPONENTS, TO BE USED AS A BUCKET ON A SPRAYING TOOL," which is hereby incorporated herein by reference in its entirety and for all purposes.

TECHNICAL FIELD

This disclosure relates to a full disposable set for packaging, preparing and working with a paint or spray gun, allowing the possible storage, preparation, and application storage of a product derived from a mixture of at least two components.

More particularly, the disclosure relates to a standard kit or a disposable kit, each containing two or more components to be mixed prior to use after the kit is mounted on a paint gun using an adapter piece. For projecting or spraying the product thus obtained, it is then necessary to transfer it to the cup of the gun used.

BACKGROUND

In the field of bi-component products and, more generally, multi-component products to be used for painting, projecting or spraying, such as paints, primers, varnishes and others, each of the two or more components of the final product must be packaged separately. These components are mixed at the last moment, just before use, because after a while it is not possible to project or spray them, since they can solidify, harden or become soggy. In addition, these components are generally sensitive to air and/or light and must be packed separately in sealed and/or opaque containers.

When a bi-component or multi-component product has to be sprayed, the operator must generally perform the premixing of the product components himself before transferring the mixture into a container adapted to its spraying tool; each of the product components is then individually packaged in a separate container.

This preparation of bi-component or multi-component products to be sprayed has many disadvantages, which include, in particular:

- large and expensive commercial packaging for the bi-component product, because each component must be individually packaged in a separate container;
- risk of overturning and loss of components or products during the preparation of the product to be sprayed, due to multiple transfer operations from one container to another;
- risk of incorrect dosage by the operator during the preparation of the product to be sprayed, which can impair the efficiency of the bi-component product obtained;
- bulky storage of partially emptied containers for each of the components after mixing,

- air deterioration of the remaining components stored in partially emptied containers;
- preparation time required during the mixing of components along with the increasingly high cost of labour leads employers to find solutions to help increase the speed of interventions.

In the field of painting or spraying by means of a tool such as a gravity gun, a suction gun or similar devices, there is very little disposable bi-component packaging.

An example of this type of packaging is two flexible plastic bags interconnected to the tip by a connection comprising a pipe. One of the bags contains the first component, for example, of the resin and the second contains the activator acting as a hardener. The mixture of the two products is obtained by superimposing one bag on the other, after breaking the shutter of the pipe connecting the two bags during the folding of the pipe.

This packaging has the disadvantage of being fragile because it is made of a flexible material. It is subject to punctures and perforations during handling. It is also more sensitive to temperature changes than rigid packaging and therefore requires special precautions for handling and storage.

Moreover, it does not have the modularity needed to contain products with different dosages.

In addition, the absence of a vent causes a slight loss of load during the spraying work, which may affect the proper operation and performance of the sprayer and the quality of work.

Furthermore, in the field of spraying by means of a tool such as a spray paint gun, suction gun and other similar devices, there is already a disposable cup solution intended to contain a liquid product to be sprayed by means of a spray tool. Unlike the field of products packaged in aerosol, there is no disposable cup with prefilled liquid spray material which would save cleaning time and reduce overall usage of solvent-based cleaners, which are often not very environmentally friendly.

Similarly, there is at present no disposable container solution comprising at least two components that are individually packaged and mixed prior to use and that can be mounted as a cup on a spray gun.

SUMMARY

In order to make the paint or spray job easier and faster as well as more economical in terms of products and materials, the presently described embodiments aim to provide a packaging and work set using a disposable cup to be mounted on a spray tool.

This assembly for the preparation, application and storage of a bi-component or multi-component product remedies all the aforementioned drawbacks and provides additional advantages related to its own peculiarity.

To this end, the presently described embodiments relate to a disposable assembly intended for packaging, preparation and application of a bi-component or multi-component product obtained from at least two components to be sprayed by a spray or paint tool.

This disposable assembly is to be mounted on a gravity or suction spray tool and has a container body with a side surface, a bottom and an opening. In the preparation phase, it constitutes a unit for preparation of a product to be sprayed derived from mixing at least two components contained in closed and separated volumes including a main volume. The contents of one or the other are released into the main volume.

The objectives of the presently described embodiments are achieved using a disposable assembly for storing components individually and separately in a closed volume, for preparing and spraying a product obtained from a mixture of at least two components by mounting the disposable assembly on a spray or paint tool, the said disposable assembly being intended to form a complete disposable cup adaptable to all tools and types of gravity or suction spray tools; this assembly comprising a packaging unit for the components, said unit contains a body with a sidewall, a bottom and an outlet opening for the final product to be transferred to the spray or paint tool, characterised in various embodiments in that:

- the body is closed until the mixture of the components, and is intended to contain the first component in its free volume;
- the bottom has a mounting projection extending into the body;
- at least one hollow element, defining at least one closed additional volume which is intended to contain one of at least two components and whose lower end is intended to be tightly mounted on or around the mounting projection, while its other end is closed by a sealing device;
- a shutter tightly mounted on the opening of the body of the disposable assembly using screws or by clipping, fitting or by any other means;
- the assembly comprising an adapter enabling the body to be mounted on all the spray tools and to be dissociated from it to be discarded;
- and in that when the mixture of at least two components is created, the disposable assembly is mounted on the spray tool using the adapter to form a complete cup, which helps to perform the spray or paint work on a surface or an object with the spray or paint tool.

According to an embodiment of the disposable assembly compliant with the present disclosure, the shape of the lower end section of the hollow element is complementary to that of the mounting projection.

According to an embodiment of the disposable assembly compliant with the present disclosure, the body is made of rigid or semi-rigid plastic, metal or cardboard.

According to an embodiment of the disposable assembly compliant with the present disclosure, the hollow element is a tubular element.

According to an embodiment of the disposable assembly compliant with the present disclosure, the hollow element is a rigid tubular element.

According to an embodiment of the disposable assembly compliant with the present disclosure, the other end of the hollow element is closed by a sealing device.

According to an embodiment of the disposable assembly compliant with the present disclosure, the sealing device has a vent.

According to an embodiment of the disposable assembly compliant with the present disclosure, the bottom has an opening disposed centrally or eccentrically forming an air passage whose opening is equipped by a sealable vent device.

According to an embodiment of the disposable assembly compliant with the present disclosure, the mounting projection has an annular, square, triangular, oval, polygonal or conical shape demarcated by a support frame.

According to an exemplary embodiment of the disposable assembly compliant with the present disclosure, the sealing device is a cap whose depth is chosen so as to fill the volume of air that can exist in the upper portion of the hollow tubular element when the aforesaid element contains the second component.

According to an exemplary embodiment of the disposable assembly compliant with the present disclosure, the sealing device is a lid or any other removable sealing means.

According to an embodiment of the disposable assembly compliant with the present disclosure, the end of the hollow tubular element which is closed by the sealing device is fixed or secured tightly to the shutter.

According to an embodiment of the disposable assembly compliant with the present disclosure, the hollow tubular element and the shutter are a single piece, forming a tank shutter.

According to an embodiment of the disposable assembly compliant with the present disclosure, the sealing device is fixed or secured tightly to the shutter.

According to an embodiment of the disposable assembly compliant with the present disclosure, the sealing device and the shutter are a single piece.

According to an embodiment of the disposable assembly compliant with the present disclosure, the sealing device is in the form of a projection of an annular, square, triangular, oval, polygonal or other shape.

According to an exemplary embodiment of the disposable assembly compliant with the present disclosure, the shutter has a through-opening for filling the disposable assembly (1) with the first component, this through-opening being closed by another sealing device.

According to an embodiment of the disposable assembly compliant with the present disclosure, the other sealing device is in the form of a cap, lid or any other sealing means.

According to an embodiment of the disposable assembly compliant with the present disclosure, the cap has a vent for the passage of the air expelled while filling the hollow tubular element containing another component.

According to an exemplary embodiment of the disposable assembly compliant with the present disclosure, the shutter is adapted to be removed partially or in its entirety.

According to an embodiment of the disposable assembly compliant with the present disclosure, it also comprises a protective part or a cover mounted above the shutter using screws or by clipping, fitting or any other means on the opening of the body.

According to an embodiment of the disposable assembly compliant with the present disclosure, the cover passes through an opening forming an air passage, this opening being provided with a closable vent device.

According to an embodiment of the disposable assembly compliant with the present disclosure, the body comprises two parts; the inner part and the outer part can slide into one another, its outer part is transparent and comprises the bottom of the body, and the inner portion is withdrawn with the hollow tubular element.

According to an embodiment of the disposable assembly compliant with the present disclosure, the body has a transparent side wall.

According to an embodiment of the disposable assembly compliant with the present disclosure, the mounting projection is conical in shape.

According to an embodiment of the disposable assembly compliant with the present disclosure, the mounting projection has a through-pipe that can serve as an air passage to ensure the function of a vent and/or filling pipe for the component occupying the additional volume of the hollow tubular element, the said air passage being initially closed by means of a removable sealing part.

According to an embodiment of the disposable assembly compliant with the present disclosure, the mounting projection can be sealed with an additional cap.

According to an embodiment of the disposable assembly compliant with the present disclosure, the body comprises at least two hollow tubular elements, each containing a component to be mixed with the first component contained in the free volume of the body.

BRIEF DESCRIPTION OF THE FIGURES

Other characteristics and advantages of the presently described embodiments will be explained in the following description by way of examples and accompanied by drawings in which.

DETAILED DESCRIPTION

Figure 2:
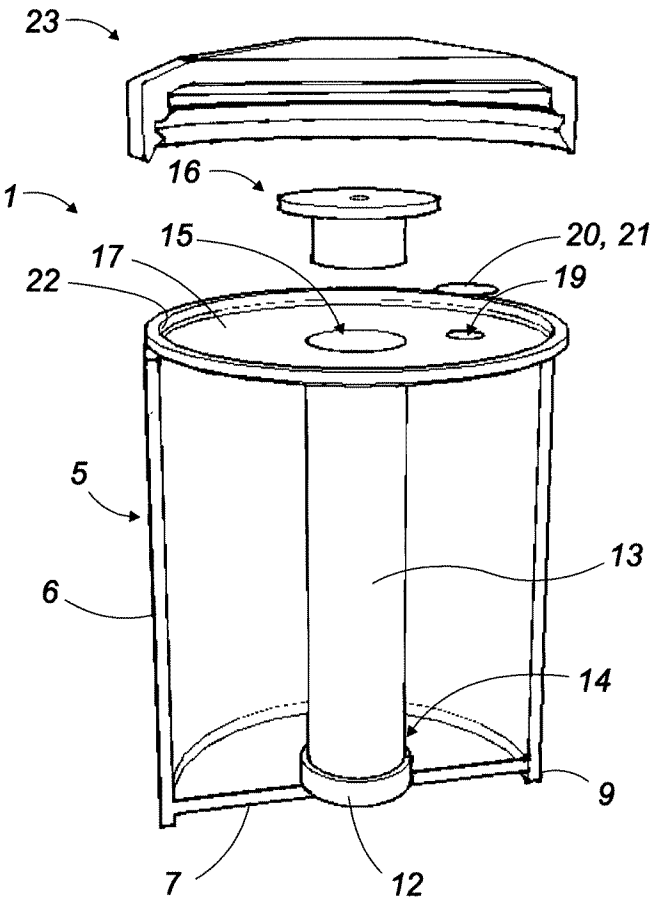
FIG. 2 is a partial sectional and perspective view of the disposable assembly according to a first embodiment, shown partially dissociated.
Figure 1:
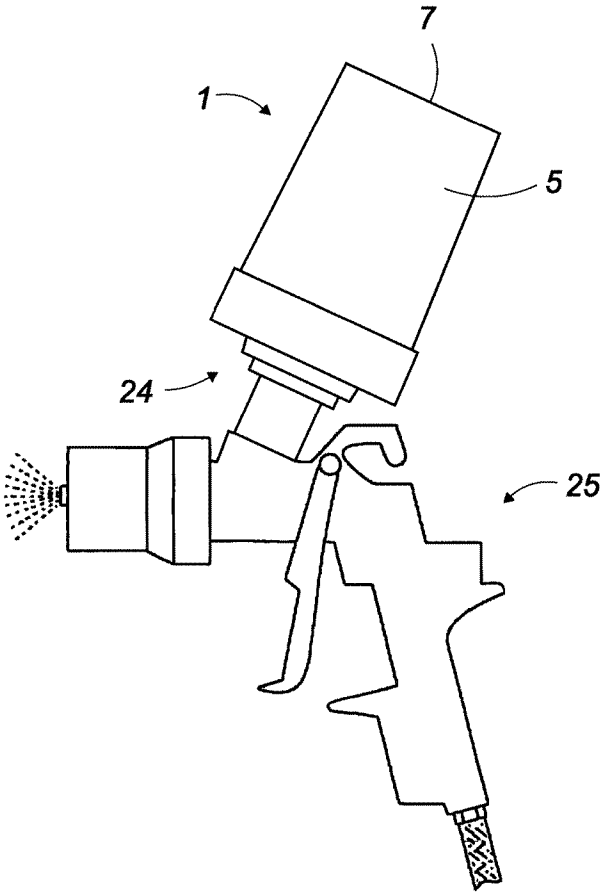
FIG. 1 is a profile view of the disposable assembly mounted on a gravity spray gun.

The disposable assembly compliant with the presently described embodiments is to be mounted on a paint or spray tool for the packaging, preparation, application and storage of a bi-component or multi-component product to be painted, sprayed or projected.

This description mainly pertains to a bi-component product. The increase in the number of components is reflected in the relative increase of individual additional volumes, each containing the components.

The disposable assembly (1) for the packaging, preparation and application of a bi-component product (2) to be painted or sprayed obtained from two components (3 and 4) is in the form of a container whose body (5) has a general shape, for example, cylindrical, cylindro-conical or truncated like a pot with a lateral surface (6), a bottom (7) and an opening (8). This rigid, semi-rigid or flexible body is intended to contain the first component (3) and can be made of plastic, metal, cardboard or can be in the form of a flexible bag.

The bottom (7) of the disposable assembly (1) can be located at a certain distance from the support edge of the lateral surface (6) with the presence of an extended end edge (9) of the bottom (7) projecting from the lateral surface (6) whose edge serves as a support for the bearing surface of the body (5). The bottom (7) can also pass through an opening (10) forming a passage for air, acting as a vent, to replace the volume of the bi-component product used and thus to allow it to flow out of the body (5). This air passage opening (10) can be placed centrally or eccentrically. It is preferably equipped with a closable vent device (11).

The bottom (7) preferably has a mounting projection (12) in the form of a technical conformation or a part integrated or inserted in the mass of the bottom. It extends inside the body (5) of the disposable assembly (1). It is preferably a mounting projection (12) of an annular shape, although the shape and dimensions of this projection are not restrictive. The mounting projection (12) may be square, triangular, oval, polygonal, conical or of any other shape as well as solid or hollow.

A hollow volume inside the body (5), separate from the one present in the body (5), for example, a hollow tubular inner element (13), is intended to contain the second component (4). The inner hollow tubular element (13) is preferably rigid, but can be semi-rigid or even flexible. It is intended to be placed in the inner volume of the body (5) and be tightly mounted in or around the mounting projection (12) at one of its ends, preferably its lower end (14), while its other end (15) is closed with a closing means such as a sealing wall or a sealing device (16). In order to ensure sealing during storage and before the preparation, the inner shape of the lower end (14) has a shape complementary to that of the mounting projection (12). The single pressure contact must ensure proper sealing.

If the final product used after mixing to spray or project is, for example, a paint, a primer, a coating or a varnish, the first component (3) can be a solvent or a binder and the second component (4) a filler or a hardener.

The sealing device (16) is preferably a cap whose depth, or length, is chosen so as to fill the volume of air that can exist in the upper portion of the hollow tubular element (13), when it contains the second component (4). Thus, by varying the length of this cap, the volume occupied by the second component may be more or less significant. The cap will preferably include a discharge means for the air expelled when it collapses, shown in the form of a circle on the head of the cap.

The sealing device (16) may also be in the form of a lid or any other removable sealing means.

In a first embodiment shown in FIGS. 2 to 4 and 7 to 18, the upper end (15) of the internal volume demarcated by the hollow tubular element (13) enclosed by the sealing wall or the sealing device (16) is fixed or secured tightly to a shutter (17) tightly mounted on the opening (8) of the body (5) of the disposable assembly (1).

Figure 4:
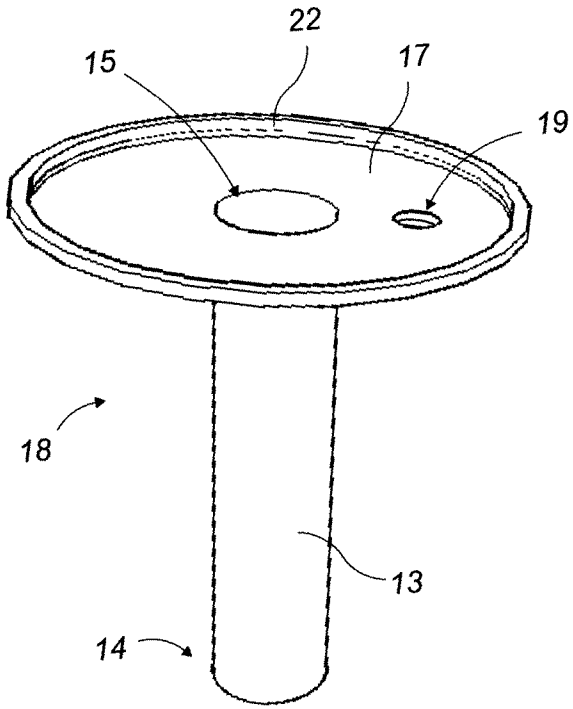
FIG. 4 is a perspective view of the tank shutter missing in FIG. 3.
Figure 3:
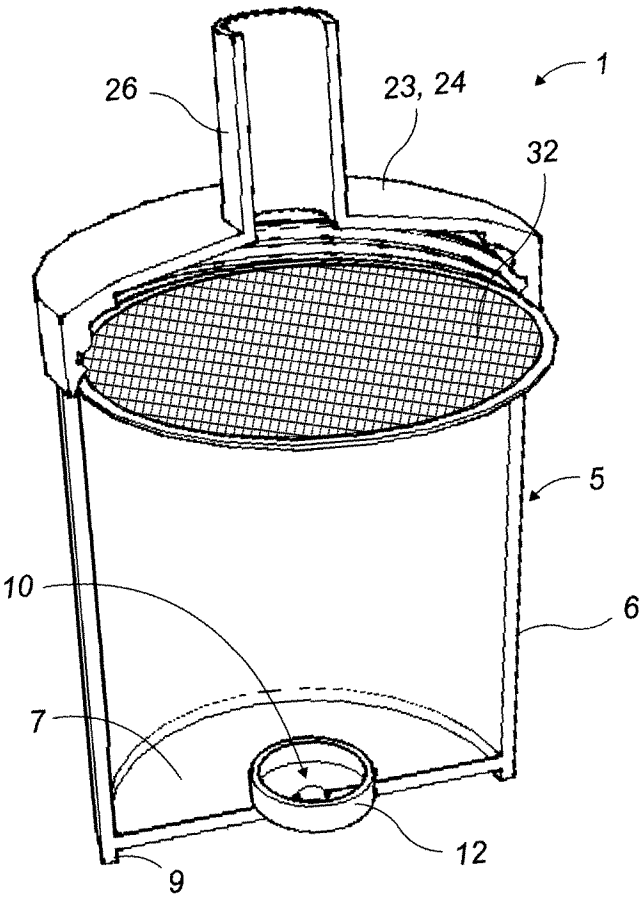
FIG. 3 is a perspective and partially sectional view of the disposable assembly according to the first embodiment, with the tank shutter, shown with a filter and a dispensing cone lid, and in which the tank shutter is absent.

According to a preferred embodiment shown in the figures, the hollow tubular element (13) and the shutter (17) are made of a single piece, forming a tank shutter (18) as shown independently in FIG. 4.

Figure 6:
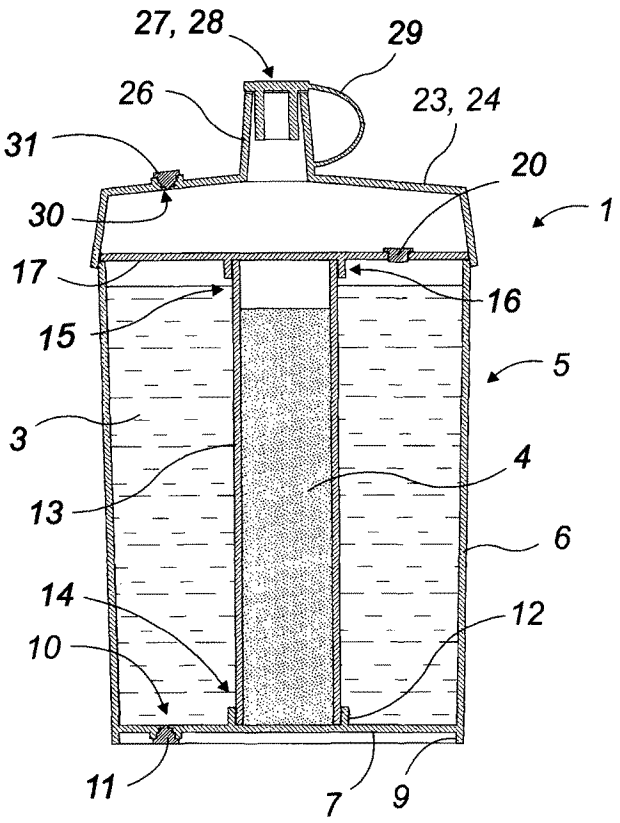
FIG. 6 is a sectional view of the disposable assembly in FIG. 5, shown assembled and open.
Figure 5:
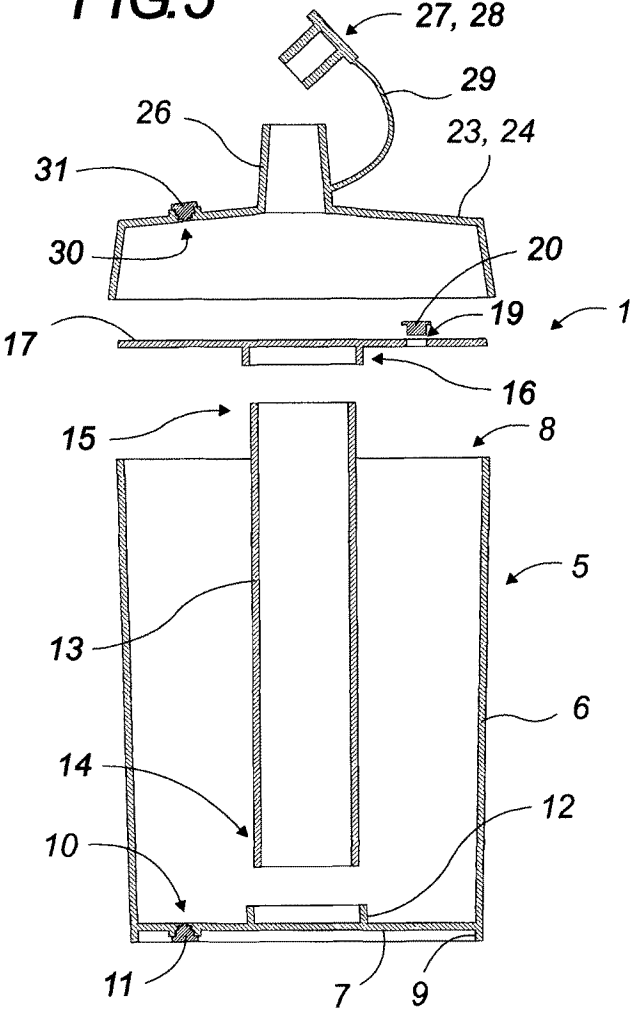
FIG. 5 is a sectional and exploded view of the disposable assembly according to a second embodiment.

According to a second embodiment shown in FIGS. 5 and 6, the sealing device 16 is fixed or secured tightly to the shutter (17), both these means being provided as one piece. In this case, the sealing device (16) may be in the form of an immobilisation projection in a ring, square, triangular, oval, polygon or other similar shape to the mounting projection (12).

As indicated, the sealing device (16) will preferably have a closable vent so as to release the air occupying its volume during its insertion.

The shutter (17) has a through-opening (19) provided for filling the remaining inner volume of the body (5) of the disposable assembly (1) by one of the components, for example, the first component (3) or the base component. This through-opening (19) is closed by another sealing device (20) that is, for example, in the form of a cap, a lid (21) or any other sealing means.

The shutter (17) is tightly mounted on the opening (8) of the body (5) of the disposable unit (1), by using screws, for example, or by clipping, fitting, bonding, crimping or any other means.

The shutter (17) may be flat or have a shoulder (22) on its periphery to mount it on the opening (8) of the body (5) of the disposable assembly (1).

The shutter (17) is intended to be removed partially or in its entirety partially, for example, by the removal of a lid provided therein (not shown).

The disposable assembly (1) may comprise a removable protective cover (23) mounted above the shutter (17) by using screws, for example, or by clipping or any other means on the opening (8) of the body (5) in order to protect the shutter (17) and the sealing devices (16) and (20) during storage and during the preparation of the final product by the mixing of the two components. This cover is also used to protect the remaining product—for example, paint—between two separate uses at two different times.

This cover (23) may have an adapter piece or part (24) intended to connect the disposable assembly (1) to a spray tool (25). In cases where the disposable assembly (1) is intended to be mounted on a spray gun, (25) particularly a gravity gun, the adapter piece or part (24) comprises a dispensing cone (26) or special technical shape at the entry of the gun as shown in particular in FIGS. 3, 5 and 6. The disposable assembly (1) then becomes a complete disposable cup.

The protective cover (23) is a separate removable and disposable part or complemented by another part to form an adapter piece, thus enabling the mounting of the body (5) on a spray or paint tool. We can thus use a complete or separate adapter piece (24) or a piece that is mounted on the cover (23).

A cap (27) or any other sealing device (28) may be provided to close the adapter piece or part (24). This sealing device (28) and the adapter piece or part (24) or the cover (23) may be one single piece, by means of a flexible connection (29), for example, as shown in FIGS. 5 and 6.

The protective part or cover (23) can also pass through an opening (30) forming a passage for the air intended to replace the volume of the bi-component product used and thus allow the flow when the disposable cup (1) is used with the cover facing upwards. This air passage opening (30) is preferably provided with a closable vent device (31), for example, similar to that present in the bottom (7) of the disposable assembly (1).

In the preferred case where a closable vent device (11), (31) is provided respectively both in the cover (23) and in the bottom (7); the disposable cup (1) can advantageously be used in a vertical position facing any direction.

Each closable vent (11), (31) may be manual or automatic.

The disposable assembly (1) preferably comprises a filter (32) provided between the cover (23) and the body (5), to prevent any impurities passing through the spray tool (25).

We will now discuss the filling of the volumes intended for the components in the body (5) of the disposable assembly (1), with reference to FIGS. 7 to 10. Although these figures illustrate the first variant, this filling process applies in a manner substantially similar to the second variant.

Figure 7:
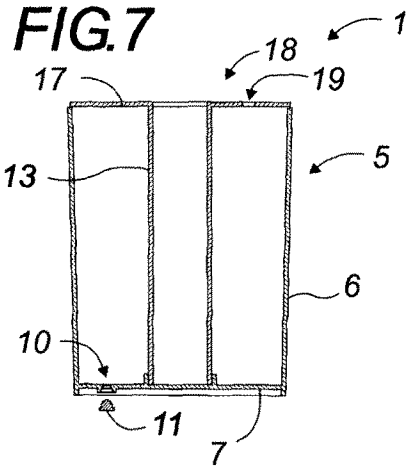

In cases where there is an opening (10) in the bottom (7), the closable vent device (11) is first inserted therein (FIG. 7). The hollow tubular element (13) and the shutter (17) are also installed in the body (5) of the disposable assembly (1), particularly ensuring that the end (14) of the hollow tubular element (13) is fitted or embedded tightly in the mounting projection (12) situated in the bottom (7) of the disposable assembly (1).

Figure 8:
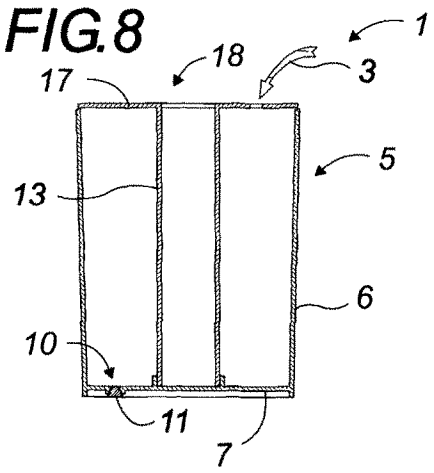

Even though the disposable assembly (1) preferably rests in a stable manner in the bottom (7) on a planar support, the first component (3) is inserted into the body (5) of the disposable assembly (1) through the through-opening (19) of the shutter (17) (FIG. 8).

Figure 9:
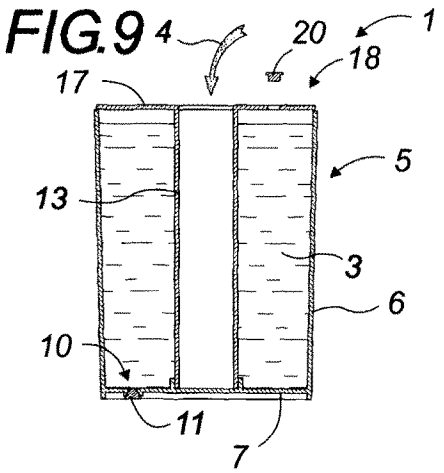
FIGS. 7 to 10 are sectional views illustrating the steps for filling the disposable assembly according to the first embodiment.

The through-opening (19) is then closed by the sealing device (20) while the second component (4) is inserted into the hollow tubular element (13) through its open end (15) (FIG. 9).

Figure 10:
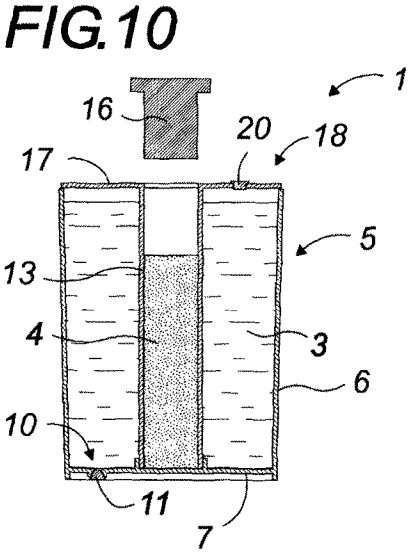

The end (15) of the hollow tubular element (13) is then tightly closed using the sealing device (16) (FIG. 10).

The two components (3) and (4) are then tightly placed in the disposable cup (1) and can be kept there for a long period until use.

Figure 12:
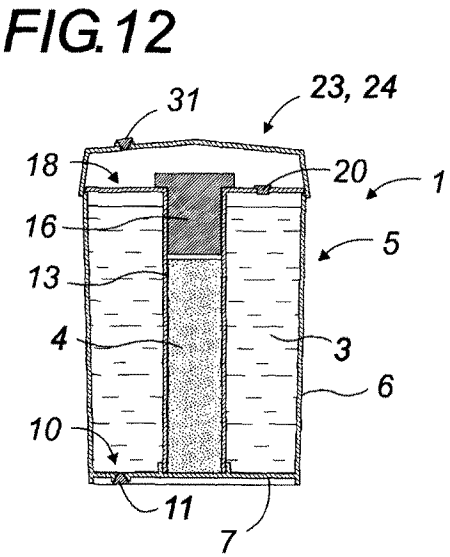
FIGS. 11 and 12 are sectional views of the disposable assembly according to the first embodiment showing two types of packaging.
Figure 11:
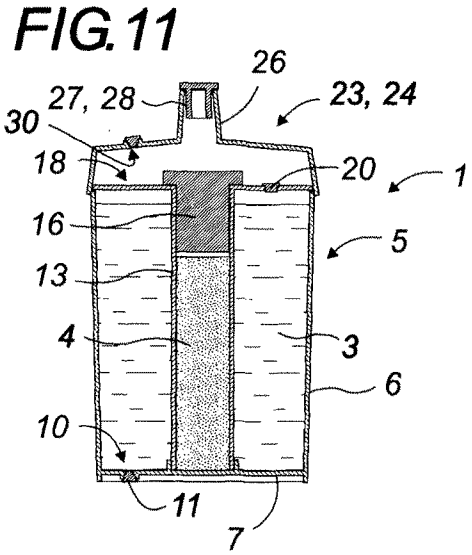

The body (5) of the disposable assembly (1), once filled, is protected by the protective part or the cover (23) whether or not it comprises an adapter part or piece (24) (FIGS. 11 and 12). It may also be packaged with both a standard cover (23) and a cover (23) comprising an adapter part or piece (24).

We will now discuss the use of the disposable assembly (1), with reference to FIGS. 13 to 18. Although these figures illustrate the first variant, as above, the use substantially works the same way for the second variant.

Figures 13, 14, 15, 16, 17, 18:
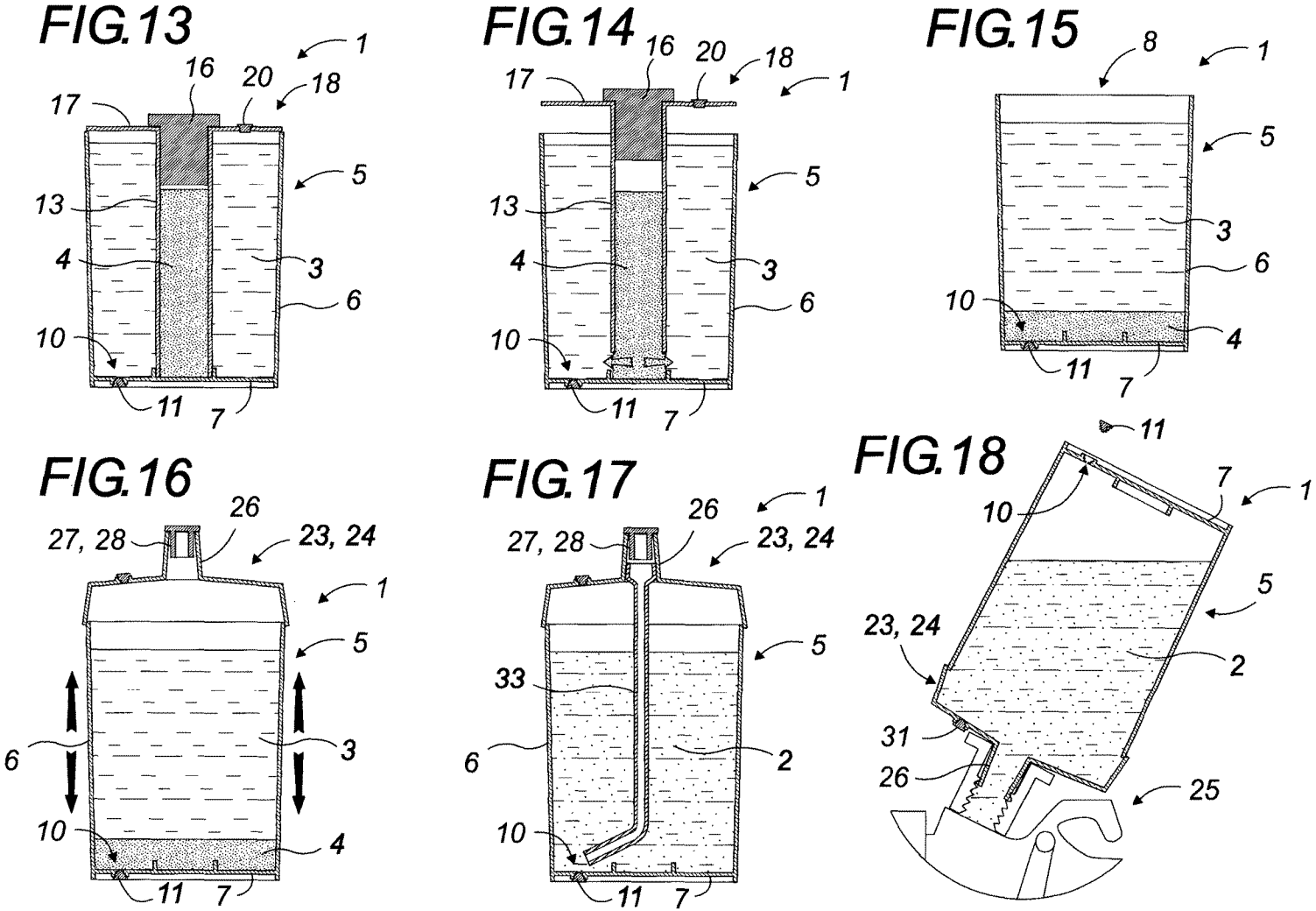
FIGS. 13 to 18 are sectional views illustrating the steps for using the disposable assembly according to the first embodiment.

The protective part or cover (23) covering the body (5) of the disposable assembly (1) is first removed and the body (5) is placed in a stable manner on its bottom (7) on a planar surface (FIG. 13).

The hollow tubular element (13) and the shutter (17) are then removed and can be disposed of (FIG. 14). The two components (3) and (4) are then brought into contact by releasing the contents of the hollow tubular element (13). They are both located in the body (5) of the disposable assembly (1), but do not mix unless particularly miscible (FIG. 15).

Before the two components (3) and (4) are mixed, the cover (23) is tightly mounted on the opening (8) of the body (5) of the disposable assembly (1) and then the entire assembly is shaken by the user (FIG. 16). A ball may be provided or introduced into the body (5) of the disposable assembly (1) in order to achieve a certain homogenisation of the two components (3) and (4).

If necessary, the operator can also insert a stirring tool in the body (5) of the disposable assembly (1) in order to mix the two components (3) and (4).

Similarly, according to one embodiment, the cover (23) can be replaced by the shutter (17) during the stirring of the two components (3) and (4).

The body (5) of the disposable assembly (1) thus contains the bi-component product (2) that is ready for use, that is to say, ready to be sprayed. It is advisable to close the body (5) by means of the cover (23); this significantly increases the service life of the bi-component spray (2) product (FIG. 17).

The body (5) of the disposable assembly (1) can then be mounted on a spray tool (25) for spraying the bi-component product (2) that it contains. If this is the case, do not forget to release the opening (10) or (30), located in the upper part, in order to form an air passage intended to replace the volume of the bi-component used and to allow the flow (FIG. 18).

As shown in FIG. 17), if the body (5) of the disposable assembly (1) is used with the cover (23) facing upwards, for example adapted to a suction gun (25), a dip tube (33) can be mounted in the cover (23), preferably on the adapter part or piece (24) and positioned so that it can be dipped into the body (5) of the disposable assembly (1), so that the bi-component product (2) can be suctioned through this dip tube (33) to be sprayed.

After use, the bi-component product (2) may be kept for some time in the body (5) of the disposable assembly (1) in anticipation of future use, although the service life is usually short and limited. When the bi-component product (2) has been exhausted or its service life is complete, the disposable assembly (1) is deemed to have been used and can be discarded.

Figure 19:
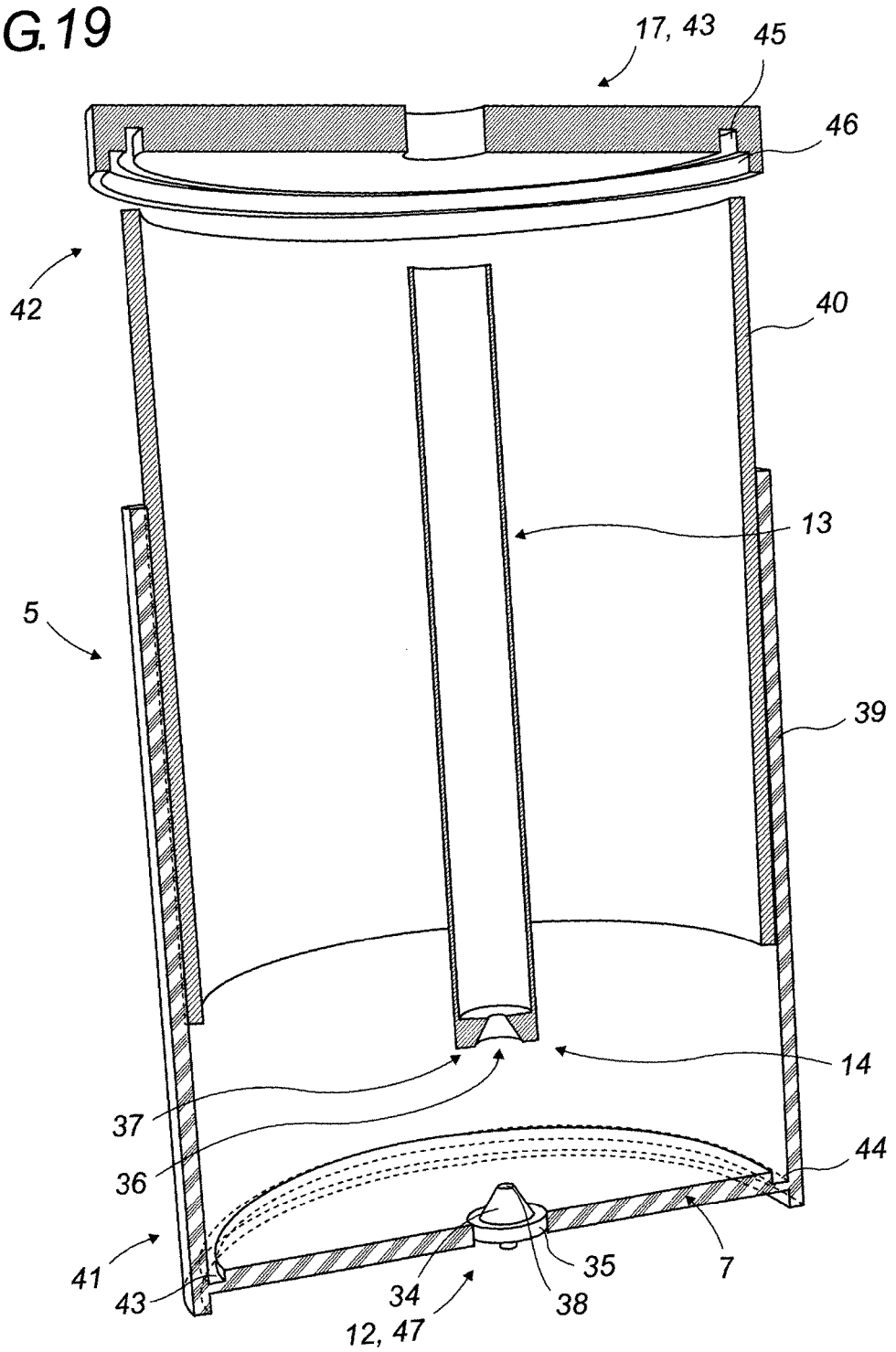
FIG. 19 is a combined perspective and sectional view illustrating another alternative embodiment of an assembly which is compliant with the presently described embodiments and has a conical projection and a transparent side wall.

FIG. 19 relates to a particular variant in which the lower end (14) of the central inner tubular element (13) rests on a conical projection (34) demarcated by an annular support edge (35). The lower end (14) of the central inner tubular element for this purpose has a complementary inner reception conformation i.e. an adapted conical cavity (36) which is bordered by an annular zone (37). Before mixing, the components contained in separate volumes must be isolated from each other. Contact between the complementary conical shapes and the respective annular edges helps to ensure sufficient sealing. During the preparation by mixing of two components, the conical shapes are dissociated from one another and the volume contents of the hollow tubular element (13) is thus released and flows into the volume of the body (5) containing the first component. The two components are then vigorously mixed by, for example, vigorous stirring of the body (5).

The conical projection (34) shape can be formed within the material of the bottom (7) or inserted in the central part of the bottom (7) or be in the form of a separate part for mounting generally referenced (12) in the entire description. According to the variant shown, this mounting part is hollow, that is to say it has an internal passage (38) for allowing air and liquids or pasty or granular products to pass through or being sufficiently hollow to receive another part as a shutter or cap. Its inner passage can of course be equipped with a closable vent.

This passage may advantageously serve as a filling pipe of the hollow tubular element (13) containing the second component (4) and may be closed after filling.

The variant shown in FIG. 19) also has the following feature. The body (5) is made of two parts forming two cylindrical side walls of which one outer cylindrical side wall is transparent (39) and one inner cylindrical side wall is opaque (40).

More particularly, it is a cup (41) with a transparent side surface (39) whose bottom is the bottom (7) of the body (5) with its central mounting projection (12) for the inner tubular element (13). The cylindrical side wall of a movable and extractable assembly (42) of the cup (41) can slide along the said transparent side wall (39) of the cup (41). It comprises an opaque cylindrical element forming the opaque side wall (40) of the inner cylindrical volume of the body (5), which is in contact with the first component (3) and a sealing part (43) which acts as a shutter (17) and is fixed or connected to the upper end of the hollow tubular element (13).

The bottom (7) of the cup (41) has an inner peripheral groove (44) for receiving, in a sealed manner and for its temporary retention by embedding, the lower peripheral edge of the side wall of the movable assembly (42). The upper edge of the opaque side wall (40) is embedded in a corresponding upper groove (45) of the upper sealing part (43) of the body (5). The upper sealing part (43) is advantageously covered by the protective part or cover (23) or the adapter piece (24) while the upper edge of the transparent side wall (39) is placed on a peripheral shoulder (46) provided in the upper sealing part (43).

After the mixture, the movable assembly comprising the opaque wall is removed, thus allowing the transparent outer side surface to be seen. This variant thus has the advantage of informing the user about the level of liquid remaining during operation and the position of the liquid in the inner volume.

Figure 20:
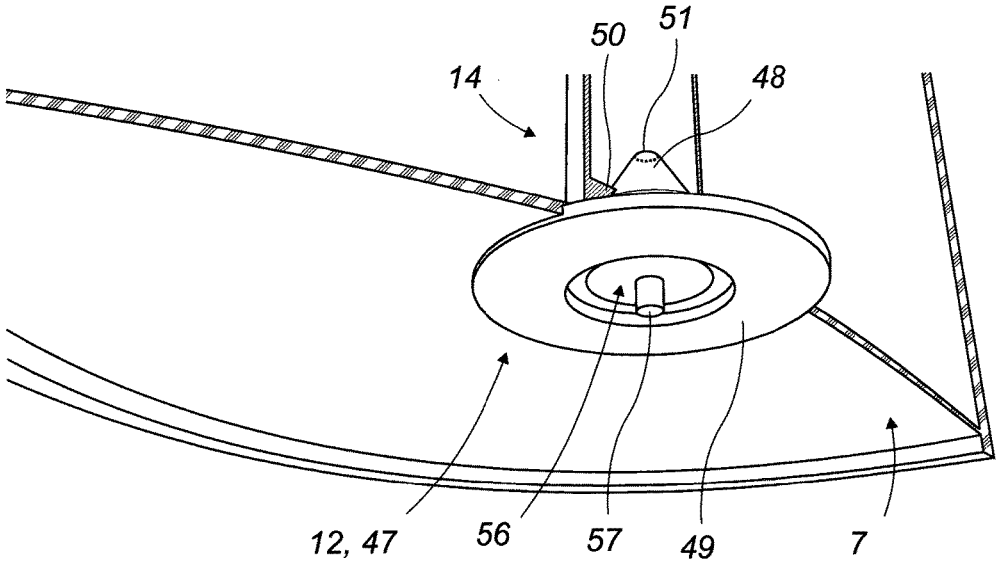
FIGS. 20 and 21 are detailed sectional and perspective views showing an alternative embodiment of an assembly compliant with the presently described embodiments, with the inner tubular element sealed with a conical and closable projection.
Figure 21:
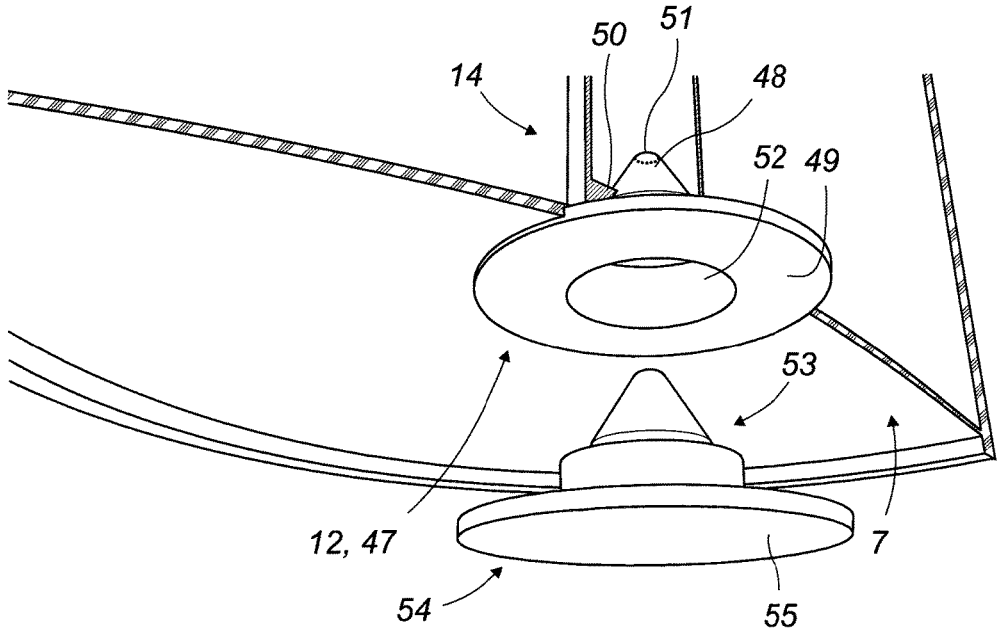

FIGS. 20 and 21 show a particular embodiment of the mounting part (12); this embodiment seals the lower end (14) of the hollow inner tubular element (13). It is a part (47) with central conical projection (48) which is solid or hollow and has a circular disc base (49) extending upward from the said central conical projection (48). This central conical projection (48) is tightly fitted or embedded in a complementary hollow conical shape (50) placed in the lower end (14) of the inner hollow tubular element (13) having a adapted complementary shape.

The hollow shape for this mounting part is preferred because it serves as a vent and helps in the return of the component when the volume of the hollow tubular element is being filled (13). In this case, this passage opens upward by way of an orifice (51). If the shape and volume of the cavity (52) of the hollow inner volume of the conical projection part (47) are adequate, it can receive the projecting part (53) that has a complementary shape (for example, like a truncated cone) of a removable sealing part (54) as shown in FIG. 21 acting as a cap with a circular base (55), thereby providing proper temporary sealing.

The mounting part (47) with a conical projection may have a lower central part that can be split, such as a removable sealing part (56) with a gripping stud (57). At least the circular central part of its base could thus, after the split, be separated from the body of the mounting part (47) and release the inner passage, allowing the filling of the product, and act as a vent when being used in the spray tool.

To preserve the remaining product after painting or spraying, just push in the removable sealing part (54) whose front part serves as a cap in the mounting part (47), with projection provided in the bottom (7) of the body (5).

As a variant that is not shown, we can indicate a multi-component embodiment which can comprise several inner volumes, each containing a component in the form of, for example, multiple concentric tubular elements, with the volume of each of these elements being successively released in the remaining peripheral volume of the body (5).

According to the presently described embodiments, this involves separately packaging at least two components of a bi-component or multi-component product to be sprayed in a single container body that serves as a disposable cup to be mounted on a gun for painting, spraying or projecting. According to this inventive solution, each component is inserted in a distinct individual container securely separated from the other identical containers, without either of the components mixing with each other before the product is prepared for spraying. A communication can be quickly achieved between at least two of these individual containers so that at least two components can be mixed in the same space without having to be removed; in this space, the mixture remains confined. Two of the components needed for this are found in the larger container body, which can be closed by a sealed cover so as to allow the two components to be mixed by vigorous stirring of the larger container. Once the bi-component or multi-component product to be sprayed is prepared, simply mount the largest container containing the mixture on a paint or spray tool by means of an adapter piece, for example a dispensing cone cover.

Obviously, the present disclosure is not limited to the preferred embodiments described above and illustrated in the various figures; a person skilled in the art can make numerous changes to it and create other variants without departing from the scope or extent of the disclosure.

The invention claimed is:

1. A disposable assembly for storing components individually and separately in a closed volume, for preparing and spraying a product obtained from a mixture of at least two components by mounting the disposable assembly on a spray or paint tool, and said disposable assembly being intended to form a complete disposable cup adaptable to all tools and types of gravity or suction spray tools; this assembly comprising a packaging unit for the components, said unit contains a body having a sidewall, a bottom and an outlet opening for the final product to be transferred to the spray or paint tool, wherein:

the body is closed until the mixture of the components and intended to contain the first component in its free volume;

the bottom has a mounting projection extending within the body;

at least one hollow element defining at least one closed additional volume intended to contain one of at least two components, the at least one hollow element having a lower end intended to be tightly mounted on or around the mounting projection, and an upper end closed by a sealing device;

a shutter is tightly mounted on the opening of the body of the disposable assembly using screws or by clipping, fitting or any other means;

the assembly comprising an adapter enabling the body to be mounted on all the spray tools and to be dissociated from the spraying tools to be discarded, the adapter being a protective part or a cover intended to be mounted above the shutter using screws or by clipping, fitting, or any other means on the outlet opening of the body; and wherein when the mixture of at least two components is created, the disposable assembly is mounted on the spray tool with the help of the adapter to form a complete cup, which helps to perform the spray or paint work on a surface or an object with the spray or paint tool.

2. The disposable assembly according to claim 1, wherein the shape of the lower end section of the hollow element is complementary to that of the mounting projection.

3. The disposable assembly according to claim 1, wherein the body is made of rigid or semi-rigid plastic, metal or cardboard.

4. The disposable assembly according to claim 1, wherein the hollow element is a tubular element.

5. The disposable assembly according to claim 4, wherein the hollow element is a rigid tubular element.

6. The disposable assembly according to claim 1, wherein the sealing device has a vent.

7. The disposable assembly according to claim 1, wherein the bottom has an opening disposed centrally or eccentrically forming an air passage, this opening of the air passage being equipped by a sealable vent device.

8. The disposable assembly according to claim 1, wherein the mounting projection has an annular, square, triangular, oval, polygonal or conical shape demarcated by a support frame.

9. The disposable assembly according to claim 1, wherein the sealing device is a cap whose depth is chosen so as to fill the volume of air that can exist in the upper portion of the hollow element, when the hollow element contains the second component.

10. The disposable assembly according to claim 1, wherein the sealing device is a lid or any other removable sealing means.

11. The disposable assembly according to claim 2, wherein the end of the hollow tubular element which is closed by the sealing device is fixed or secured tightly to the shutter.

12. The disposable assembly according to claim 1, wherein the hollow element and the shutter are made of a single piece, forming a tank shutter.

13. The disposable assembly according to claim 2, wherein the sealing device is fixed or secured tightly to the shutter.

14. The disposable assembly according to claim 2, wherein the sealing device and the shutter are a single piece.

15. The disposable assembly according to claim 2, the sealing device is in the form of a projection of annular, square, triangular, oval, polygonal or other shape.

16. The disposable assembly according to claim 1, wherein the shutter has a through-opening for filling the disposable assembly with the first component, the through-opening being closed by another sealing device.

17. The disposable assembly according to claim 16, wherein the another sealing device is in the form of a cap, a lid or any other sealing means.

18. The disposable assembly according to claim 17, wherein the cap has a vent for the passage of the air expelled while filling the hollow element containing another component.

19. The disposable assembly according to claim 1, wherein the shutter is intended to be removed entirely or in part.

20. The disposable assembly according to claim 1, wherein the cover passes through an opening forming an air passage, this opening being provided with a closable vent device.

21. The disposable assembly according to claim 1, wherein the body comprises two parts; the inner part and the outer part can slide into one another, the outer part of the body is transparent and comprises the bottom of the body, and the inner portion is withdrawn with the hollow element.

22. The disposable assembly according to claim 1, wherein the body has a transparent side wall.

23. The disposable assembly according to claim 1, wherein the mounting projection is conical in shape.

24. The disposable assembly according to claim 1, wherein the mounting projection has a through-pipe that can serve as an air passage to ensure the function of a vent and/or filling pipe for the component occupying the additional volume of the hollow element, the said air passage being initially closed by means of a removable sealing part.

25. The disposable assembly according to claim 24, wherein the mounting projection can be sealed with an additional cap.

26. The disposable assembly according to claim 1, wherein the body comprises at least two hollow tubular elements each containing a component to be mixed with the first component contained in the free volume of the body.

27. A disposable assembly for storing components individually and separately in a closed volume, for preparing and spraying a product obtained from a mixture of at least two components by mounting the disposable assembly on a spray or paint tool, and said disposable assembly being intended to form a complete disposable cup adaptable to all tools and types of gravity or suction spray tools; this assembly comprising a packaging unit for the components, said unit contains a body having a sidewall, a bottom and an outlet opening for the final product to be transferred to the spray or paint tool, wherein:

the body is closed until the mixture of the components and intended to contain the first component in its free volume;

the bottom has a mounting projection extending within the body;

at least one hollow element defining at least one closed additional volume intended to contain one of at least two components, the at least one hollow element having a lower end intended to be tightly mounted on or around the mounting projection, and an upper end closed by a sealing device;

a shutter is tightly mounted on the opening of the body of the disposable assembly using screws or by clipping, fitting or any other means;

the assembly comprising an adapter enabling the body to be mounted on all the spray tools and to be dissociated from the spraying tools to be discarded;

wherein when the mixture of at least two components is created, the disposable assembly is mounted on the spray tool with the help of the adapter to form a complete cup, which helps to perform the spray or paint work on a surface or an object with the spray or paint tool; and wherein the hollow element and the shutter are made of a single piece, forming a tank shutter.

28. A disposable assembly for storing components individually and separately in a closed volume, for preparing and spraying a product obtained from a mixture of at least two components by mounting the disposable assembly on a spray or paint tool, and said disposable assembly being intended to form a complete disposable cup adaptable to all tools and types of gravity or suction spray tools; this assembly comprising a packaging unit for the components, said unit contains a body having a sidewall, a bottom and an outlet opening for the final product to be transferred to the spray or paint tool, wherein:

the body is closed until the mixture of the components and intended to contain the first component in its free volume;

the bottom has a mounting projection extending within the body;

at least one hollow element defining at least one closed additional volume intended to contain one of at least two components, the at least one hollow element having a lower end intended to be tightly mounted on or around the mounting projection, and an upper end closed by a sealing device;

a shutter is tightly mounted on the opening of the body of the disposable assembly using screws or by clipping, fitting or any other means;

the assembly comprising an adapter enabling the body to be mounted on all the spray tools and to be dissociated from the spraying tools to be discarded;

wherein when the mixture of at least two components is created, the disposable assembly is mounted on the spray tool with the help of the adapter to form a complete cup, which helps to perform the spray or paint work on a surface or an object with the spray or paint tool;

wherein the shutter has a through-opening for filling the disposable assembly with the first component, the through-opening being closed by another sealing device; and wherein the another sealing device is in the form of a cap, a lid or any other sealing means.

* * * * *